US005394997A

United States Patent [19]

Gollob

[11] Patent Number: 5,394,997

[45] Date of Patent: Mar. 7, 1995

[54] RACK FOR NEWSPAPERS

[75] Inventor: Edward N. Gollob, Waterloo, Canada

[73] Assignee: Go-Plastics Inc., Kitchener, Canada

[21] Appl. No.: 62,277

[22] Filed: May 17, 1993

[51] Int. Cl.[6] ..... A47F 5/00

[52] U.S. Cl. ..... 211/187; 211/50

[58] Field of Search ..... 211/187, 50; 40/124; 100/34

[56] References Cited

U.S. PATENT DOCUMENTS

| | | | |
|---|---|---|---|
| 4,429,889 | 2/1984 | Westra | 211/50 X |
| 5,042,398 | 8/1991 | Lau et al. | 211/187 X |
| 5,205,630 | 4/1993 | Welch et al. | 211/187 X |
| 5,257,701 | 11/1993 | Edelson | 211/187 X |

*Primary Examiner*—Alvin C. Chin-Shue
*Assistant Examiner*—Sarah L. Purol
*Attorney, Agent, or Firm*—Anthony Asquith & Co.

[57] ABSTRACT

The rack has wire shelves that slide into grooves moulded into the side walls of a plastic body. The free-standing body is hollow, and is formed by rotation-moulding. The body is a very rigid structure, easily able to withstand the usual abuse of a public sales-location. The side-walls extend only half way along the shelves, leaving half the shelves protruding from the side walls, and as a result, although the rack is strong and substantial, the rack is attractive in appearance, and the newspapers are presented for sale in an accessible manner. Notches in the grooves comprise detents whereby the shelves are retained in the grooves.

19 Claims, 5 Drawing Sheets

RACK FOR NEWSPAPERS

This invention relates to vending racks and stands, of the type used for supporting newspapers and the like, for presenting same for sale to the public.

A characteristic of the marketing of newspapers is that the newspapers are retail-sold from a large number of small sales locations at drug stores, convenience shops, supermarkets, etc. At the sales location, the newspapers are stacked on a rack: the customer picks the newspaper off the rack and presents the newspaper to the clerk for purchase. There are many thousands of such sales locations; each location handles, say, fifty newspapers per day, or per issue.

The invention is concerned with the rack upon which the newspapers are stored while awaiting purchase.

BACKGROUND TO THE INVENTION

The conventional rack for presenting newspapers for sale to the public comprises an open box which is structured in metal wires or bars. The wires are welded together to form sides, a back, and a floor or shelf. The box is open at the front and top.

The conventional wire frame rack has a number of shortcomings:

The wire frame rack looks cheap. As a result, at least to some extent, the customer looks on the product sold from the rack, i.e. the newspaper, as being not worth the effort of proper presentation.

The wire frame rack is flimsy. Usually the wire frame rack is low on the ground, so that the customer has to stoop to pick up the newspaper; but if the rack were higher off the ground, the rack would be even more flimsy.

Even when the rack is only of a low height, the rack can hardly survive the normal abuse, such as accidental kicks and the like, which any article in a public place is bound to receive.

Members of the public are generally very casual in their approach to the task of reaching into the rack to pick up a newspaper, and so any sharp edges (to which wires of course are prone) can be quite dangerous.

Because the wires do not stand out visually, it is common for persons to rap their fingers accidentally on the wire frame as they reach in, simply because the casual eye does not pick up the presence of the wires.

The wire frame rack is awkward for the vendor to assemble and to move about. Often, the wire rack has to be screwed to a wall to give it the rigidity it needs to withstand abuse, which means the vendor is inhibited as to where he can place the rack.

The conventional wire frame rack often has two or more shelves, but has no provision for adjusting the heights of the shelves.

In short, the wire frame rack not only looks cheap and unsubstantial, but the wire frame rack is structurally unsuited to the task of supporting newspapers for presentation for sale.

The invention is aimed at providing a rack for presenting newspapers for sale, in which the above disadvantages are alleviated.

Another type of rack which has been in public use is the type in which the rack is made all of plastic. The conventional type of plastic rack comprises a moulding which includes a shelf or table-top on which the newspapers are supported. The designer of the rack must ensure that the rack has sufficient rigidity to withstand the normal abuse as received by any piece of equipment in a public place; also, the rack must be tall enough to raise the newspapers a good distance off the floor. The taller the rack, the more chunky its structure has to be in order for the rack to have the desired degree of rigidity. It has generally been perceived that for a rack to be properly rigid, the rack has to be so chunky that the structure appears clumsy, and so the need for rigidity largely dominates the other aspects of the design of the rack. Whereas the wire frame rack lacks visual appeal because it is so flimsy, the plastic rack lacks visual appeal because it is so chunky.

Given the dimensions that a newspaper rack has to have, and the rigidity it has to have, both the wire frame construction and the all-plastic construction have the wrong characteristics of bulk-to-rigidity, at least from the visual standpoint: the wire frame does not look substantial enough, whereas the plastic construction looks too cumbersome.

The invention is aimed at providing a rack which presents the newspapers at a good height from the ground, and yet which has the rigidity and robustness needed for public usage. The invention is also aimed at providing a rack that can be visually appealing, in that the required rigidity is achieved in a structure which is also neat and elegant.

BASIC FEATURES OF THE INVENTION

The rack of the invention comprises a body and at least one shelf. The body comprises sides and a back, and is formed as a unitary, rigid structure, separate from the shelf. The body is hollow-moulded in plastic, and preferably is rotation-moulded.

The sides of the body are provided with support means, which are effective to support the shelf with respect to the body. Preferably, the support means comprises a pair of grooves which are moulded-in to the respective side walls of the body, the grooves being of such dimensions that the shelf can slide into and out of the grooves.

The rack includes detent means, which are effective to retain the shelf to the body, and to resist detachment of the shelf from the body. Preferably, the detent means comprises a notch in the side wall of the body, and a complementary protrusion on the shelf, the arrangement of the detent means being such that the shelf can be assembled by hand-force fully into the grooves from in front of the body, and the assembled shelf is retained in the grooves by the engagement of the protrusion in the notch. Preferably, the notch is cut into the floor of the groove.

In the invention, the sides of the body do not extend forwards over the whole depth of the shelf. That is to say, the shelf protrudes forwards and out from the side walls. Preferably, the side-walls extend only about half-way along the depth of the shelf, whereby half the shelf protrudes forwards from the sides of the body.

It is recognised, in the invention, that the main bulk of the rack, i.e. the bulk required in order to give the rack the rigidity it needs to stand up straight, can be achieved by making only a portion of the rack out of bulky plastic. The shelves do not need to be of bulky plastic, but can be of the wire frame type, and the shelves need be supported only over a portion of their depth. As a result, the rack has ample rigidity, but since the bulk of the rack, which gives the rack its rigidity, is in the background, the rack itself is visually pleasing. Also, the rack presents the newspapers in an eye-catchingly attractive manner, but the rack is in no way obtrusive.

The combination of the plastic body and wire frame shelves puts the rigidity where it is needed, without the excessive bulkiness of the conventional all-plastic racks, and also allows the shelves to be wide open and accessible, and to present the newspapers in a highly pleasing manner.

As will be described, in the invention the shelves can be detachable from the plastic moulded body. The shelves can therefore be adjustable as to their height, which is a useful convenience. Also, the number of shelves can be varied, whereby the vendor may choose to present either a large number of one newspaper title for sale, or may choose to present a smaller number each of several different newspapers, each newspaper being attractively and professionally presented in its own place.

In the invention, the structure of the body makes the rack rigid enough even without the shelves being present, which allows the shelves to be detachable and adjustable. In the wire frame structure, and in the all-plastic structure, the shelf or shelves were structurally integral with the body of the rack, whereby it was difficult to adjust the height and number of the shelves.

BRIEF DESCRIPTION OF DRAWINGS

By way of further explanation of the invention, exemplary embodiments of the invention will now be described with reference to the accompanying drawings, in which.

DETAILED DESCRIPTION OF PREFERRED EMBODIMENT

The apparatuses shown in the accompanying drawings and described below are examples which embody the invention. It should be noted that the scope of the invention is defined by the accompanying claims, and not necessarily by specific features of exemplary embodiments.

Figure 1:
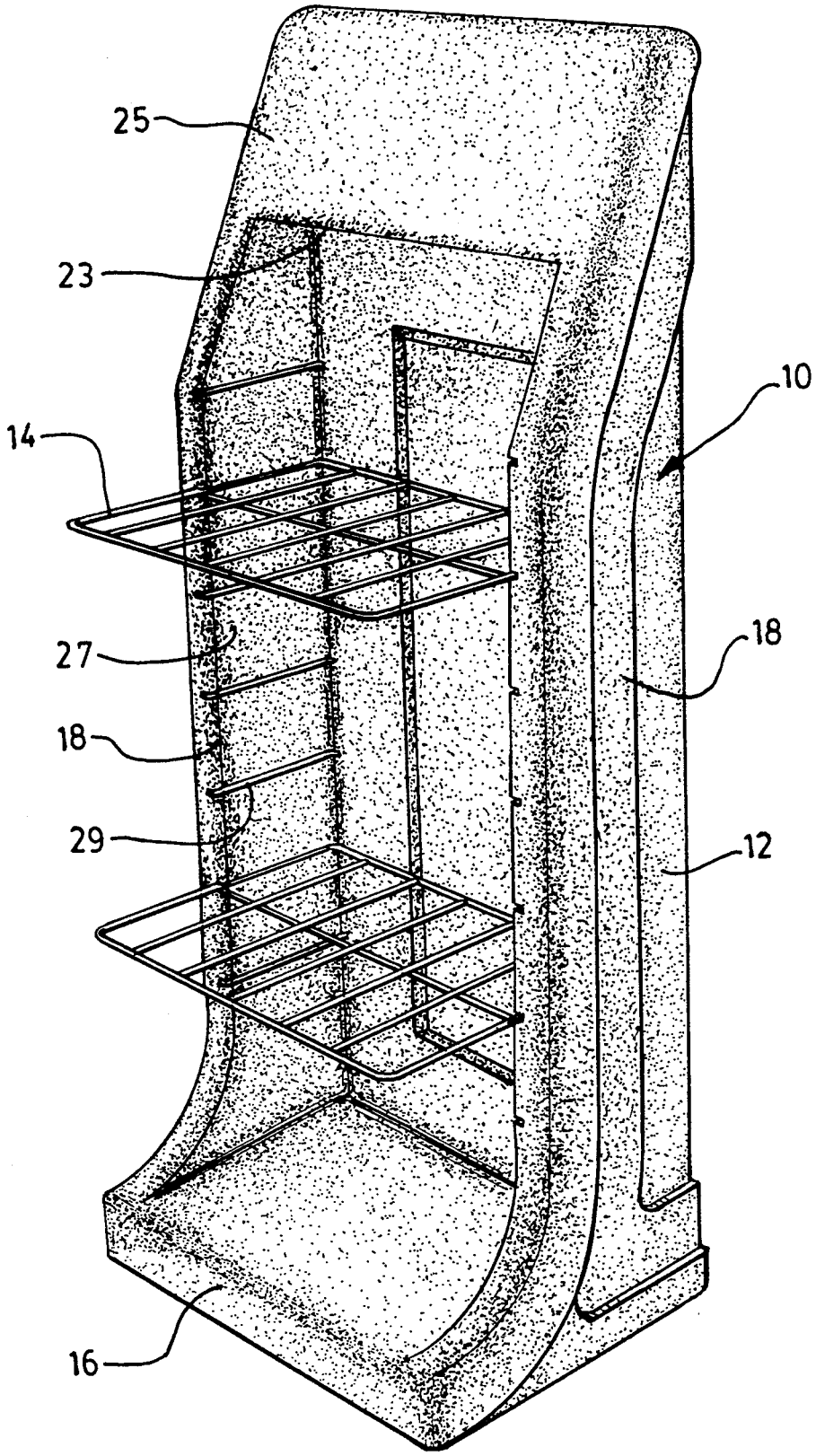
FIG. 1 is a pictorial view of a newspaper rack which embodies the invention.
Figure 2:
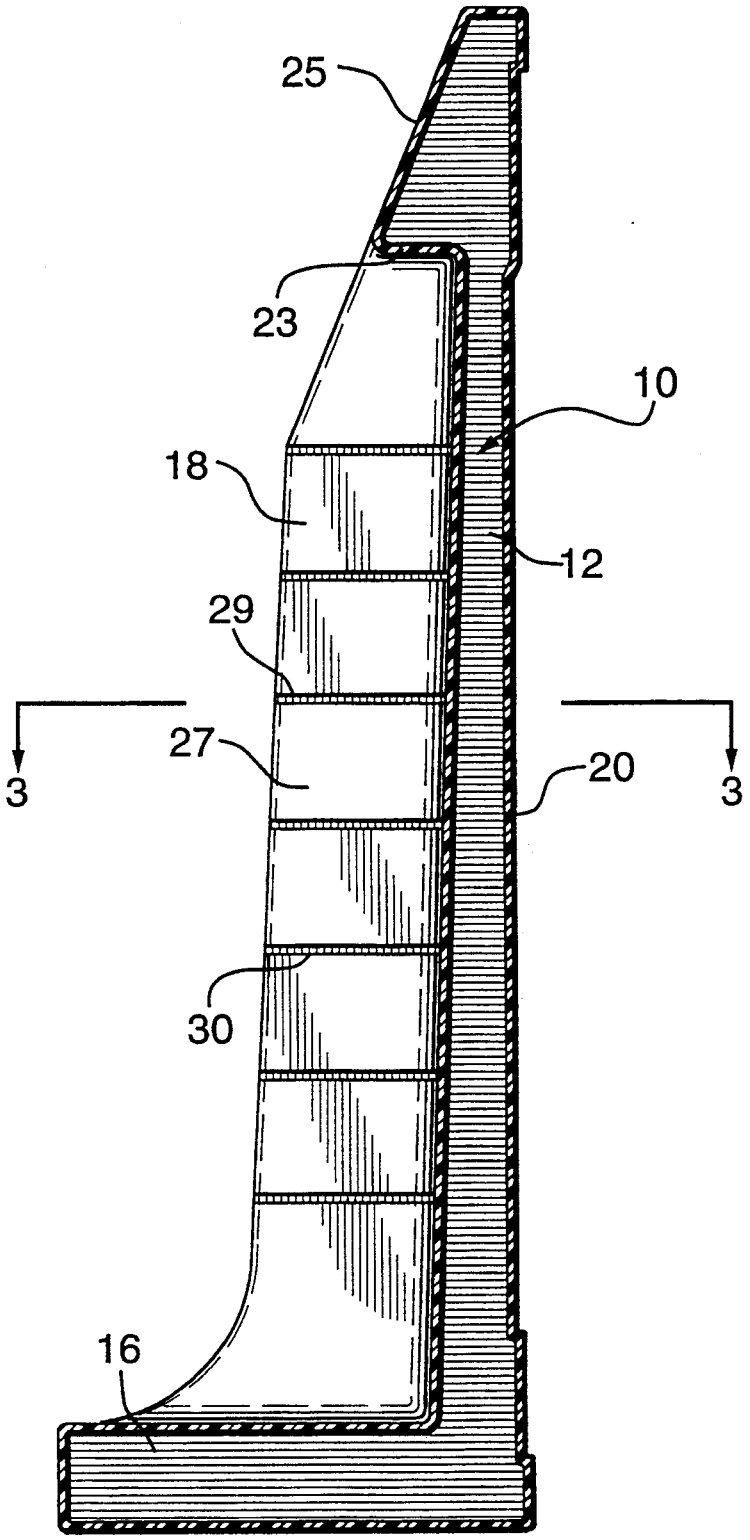
FIG. 2 is a cross-section drawn on the vertical axis of symmetry of the rack of FIG. 1.
Figure 3:
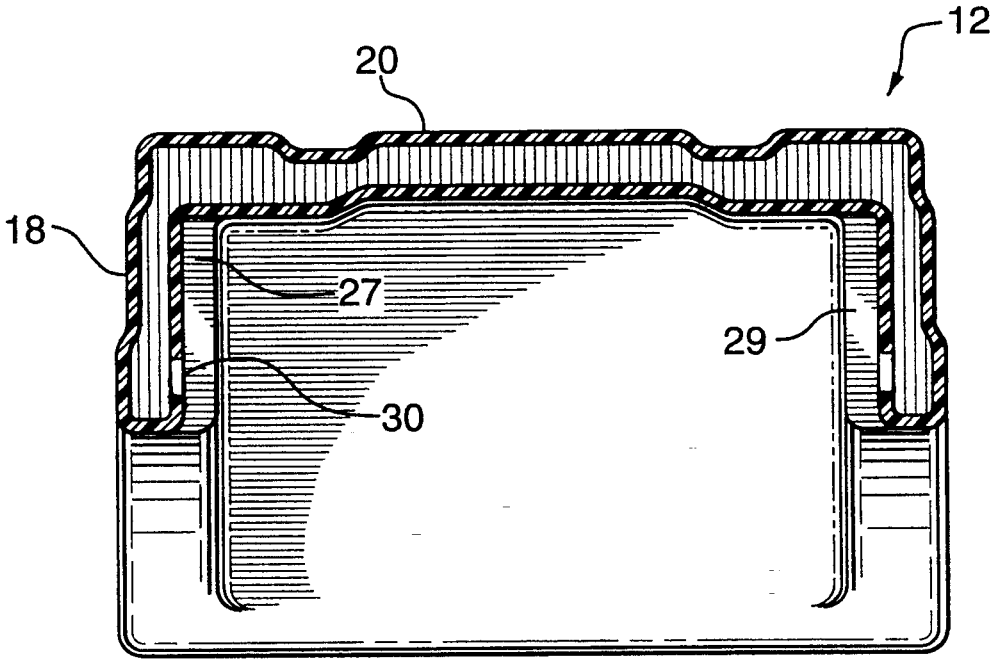
FIG. 3 is a plan view drawn in cross-section on the line 3—3 in FIG. 2, of the rack of FIG. 1.

The newspaper rack 10 shown in FIG. 1 comprises a moulded plastic body 12 and one or more shelves 14.

The body 12 is of rotation-moulded construction: that is to say, the body is produced in a mould in which heated plastic (preferably in this case polyethylene) is circulated and dispersed around the inside of a heated mould as the mould undergoes two-axis rotation; the plastic cures against the walls of the mould to form an even-thickness skin inside the mould. The body 12 is consequently of even-thickness-skin, enclosed-hollow, form.

The body 12 is formed with a base 16, side-walls 18, and a back 20. At the top of the back 20, the body is formed with an overhang 23. The surface of the body is generally of a shot-pien texture, except that a panel 25 above the overhang 23 is made smooth enough to receive pressure-sensitive decals, screen-printed messages, moulded-in .graphics, or the like, which serve as advertising announcements, etc.

As to dimensions, the body 12 is 120 cm high, and the base is 35×50 cm.

The inside faces 27 of the side walls 18 are formed with channel-shaped grooves 29. The grooves 29 are moulded into the body material, whereby the thickness of the plastic material of the body extends around, and defines, each groove.

Each groove 29 is provided with a cut-out or notch 30, which is end-milled through the thickness of the material at the base of the groove. All the notches are formed the same distance .along the respective grooves from the back 20.

Figure 4:
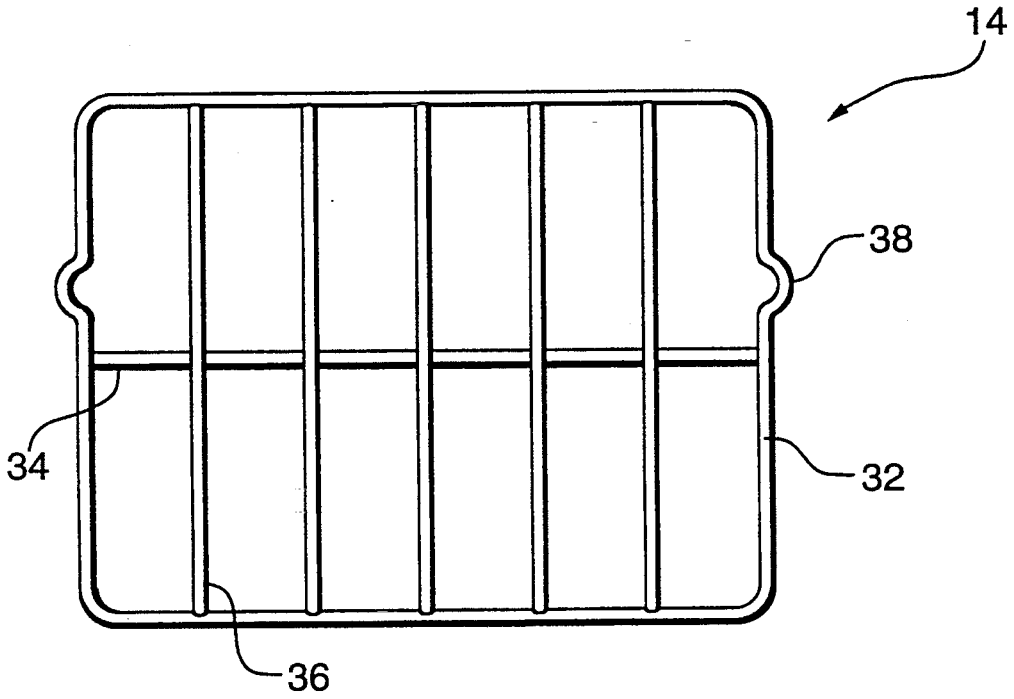
FIG. 4 is a view of a shelf, being a component of the rack of FIG. 1.

FIG. 4 shows one of the shelves 14. The shelf is of wire-frame construction, and comprises an outer frame 32 of wire which is welded into a complete loop, a crossbar 34, and rails 36. FIG. 4 shows five such rails being provided for the shelf 14.

The shelf 14 is 45 cm by 30 cm, which is the appropriate size for the storage and presentation-for-sale of (folded) newspapers. The shelf is large enough that the newspapers can be stored thereon without overhanging the edges of the shelf, and yet snug enough to contain the newspapers in a neat stack.

The outer frame 32 is formed with a kink or protrusion 38 on each of its shorter sides. The protrusion 38 is of such dimensions as to engage the cutout or notch 30 cut into the floor of the groove 29.

To assemble the shelf 14 into the body 12 of the rack, the frame 32 is inserted between a pair of the grooves, and slides in until the back of the frame reaches the back 20 of the body. The notch 30 is positioned so that the protrusion 38 engages the notch at this point. The notch and protrusion comprise a detent, whereby the shelf is retained firmly and securely in the grooves, such that the shelf will not be dislodged by public usage of the rack, and will not be dislodged even by the abuse that must be expected when a structure is in a public place. On the other hand, if the vendor wishes to rearrange the shelves at different heights, it is a simple matter for him to pull a shelf out of the grooves by hand-force, and to re-insert the shelf at the desired height. The body 12 is of such a nature that its inherent rigidity does not depend on the shelf, and is unaffected by whether or not the shelf is present.

The shelf 14 is provided with tabs 40 at the rear, whereby the shelf can be riveted or otherwise secured to the body, in case the vendor requires more permanent securement. Again, it makes no difference to the rigidity of the rack whether or not the shelf is riveted to the body.

As mentioned, the body 12 is manufactured by the rotation-moulding process. This process is particularly suitable for the body because the process so readily can be used for the thick, hollow walls as illustrated. The double-skinned hollow walls of the body are some 45 mm thick. The grooves that are moulded into the inner skin 27 of the side walls 18 do not present a corresponding unsightly protrusion on the outside of the side wall. It would not be advisable to form the grooves by cutting the material of the walls, since that would considerably weaken the walls. The small cut-out area of the notch 30, though, has little effect on the walls.

The detent notch 30 should be placed towards the front edge of the side wall 18 of the body 12, as shown, (and the protrusion 38 on the shelf 14 should be correspondingly positioned). If the detent were too far back, the back wall 20 of the body would take away some of the resilience of the material around the notch, which would tend to make the detent too stiff.

If the sides 18 of the body had to protrude as far forward as the front of the shelf 14, the rack would lose much of its attractive appearance and economy of construction. By extending the walls only half way along the depth of the shelves, the shelves are adequately supported against tipping, and the structural nature of the shelf is such that the shelf can support by itself the portion of the shelf that overhangs or protrudes forwards from the side-walls.

The rack as described is not only attractive in appearance, and robust in usage, but the rack is also light in weight, and is easily portable, if the vendor should desire to move the rack from place to place.

Figure 5:
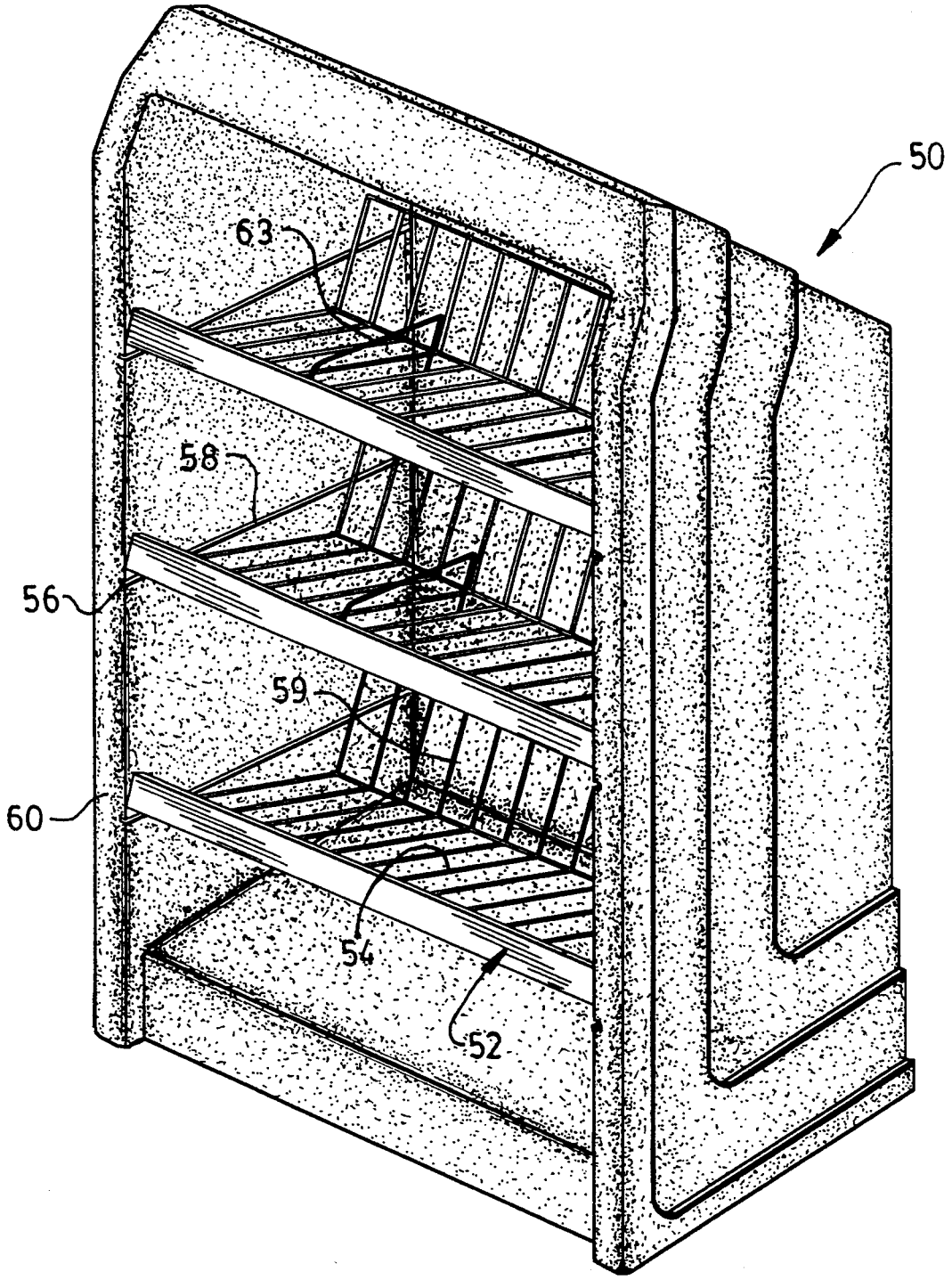
FIG. 5 is a pictorial view of another paper rack which embodies the invention.
Figure 6:
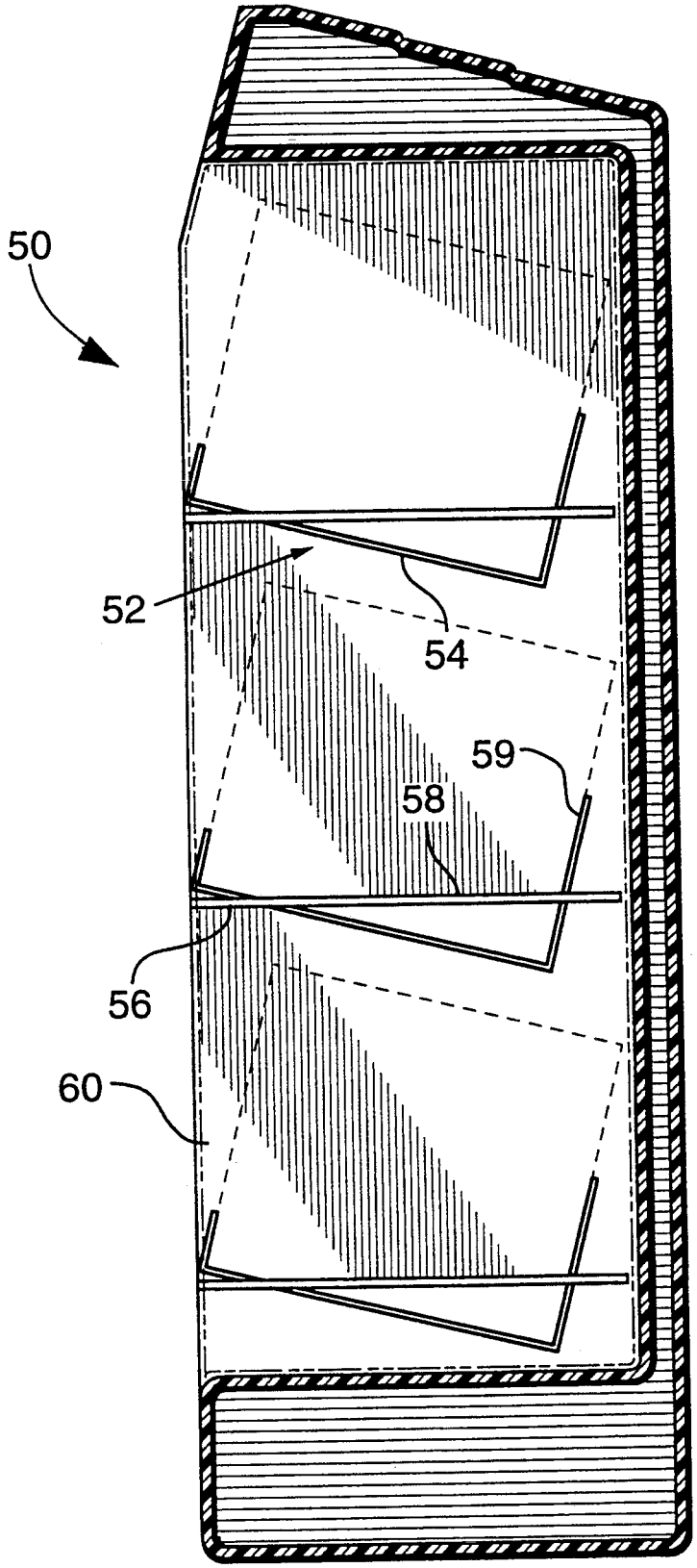
FIG. 6 is a cross-section of the rack of FIG. 5.

FIGS. 5 and 6 show a rack 50 having a shelf assembly 52, in which the floor or platform 54 of the shelf slopes backwards. When the platform slopes backwards, papers placed on the shelves are, of course, retained much more securely. This slope therefore can be advantageous when the papers being displayed and presented are pamphlets, for example, or single sheets, as opposed to newspapers. Such pamphlets or papers might not be secure enough if placed on a strictly horizontal platform, like that the wire-rack shelf 14.

It is greatly preferred that the grooves 56, like the grooves 29 in FIG. 1, be horizontal, or rather (in FIG. 1) that the grooves be at right angles to the back 20 of the body 12. The grooves 29 are so highly efficient because they are moulded into the body, and if the grooves were to lie at an angle with respect to the back 20, the mould would need to be provided with withdrawable inserts. It would add considerably to the cost of the body if the as-moulded body could not be withdrawn straight from the mould.

The shelf assemblies 52 of the rack 50 are made as wire frames. Each shelf assembly includes rails 58 which are horizontal, and it is these rails which engage the grooves 56. Therefore the grooves 56 can be horizontal, which is the preferred arrangement. The rails 58 include a detent similar to that described above, to hold the shelf in place.

Also, the rails 58 serve as braces to hold the backrest 59 of the shelf assembly firm with respect to the platform 54.

The shelves 14 of the FIG. 1 rack are flat and planar. Since the grooves preferably have to be horizontal, then the shelves 14 are constrained to be horizontal also. The shelf platforms 54 of the FIG. 5 rack are not constrained to be horizontal, because the rails 58 can serve as the horizontal component.

The rack 50 shown in FIG. 5 is wider than that shown in FIG. 1, being intended for displaying a larger number of pamphlets and single sheets. The papers will be displayed side by side on the same shelf.

The side walls 60 of the rack 50 extend right to the front of the shelves. When the displayed items were newspapers, it was not so important to protect the relatively robust stack of newspapers right to the front of the shelves, as described, but, when the papers are single sheets, full-width sides in fact are more appropriate. Shelf-dividers 63, which clip onto the wires of the platform 54, are provided to separate the different types of papers.

When the rack is wider, it is aesthetically more accepatable for the sides to extend further forward. The rack of FIG. 1 is relatively narrow, and the walls would appear perhaps over-heavy if they extended right to the front of the shelves. As to the wider rack 50 of FIG. 5, on the other hand, the dimensions of the rack are more spacious, such that extending the walls forwards does not make the wider rack seem over-heavy.

I claim:

1. Rack for supporting newspapers and the like for presentation for sale, wherein:

the rack comprises a body and at least one shelf;

the body comprises left and right side walls, and a back wall;

the left side wall of the body comprises a left inner skin and a left outer skin, which are disposed in a spaced-apart, parallel relationship, whereby the left side wall is a double-skin hollow structure;

the right side wall of the body comprises a right inner skin and a right outer skin, which are disposed in a spaced-apart, parallel relationship, whereby the right side wall is a double-skin hollow structure;

the back wall of the body comprises a back inner skin and a back outer skin, which are disposed in a spaced-apart, parallel relationship, whereby the back wall is a double-skin hollow structure;

the body is arranged with the left and right side walls protruding forwards from the back wall, whereby a space is defined between the walls, which is suitable for receiving a stack of newspapers or the like;

the body is moulded in plastic, the walls being formed together as a unitary integral rigid structure, which is separate from the shelf;

the left inner skin and the right inner skin are formed with shelf support means for supporting the shelf;

the shelf is so constructed and arranged as to be supported in the rack by the shelf support means.

2. Rack of claim 1, wherein:

the body includes a base;

the base comprises a base inner skin and a base outer skin, which are disposed in a spaced-apart, parallel relationship, whereby the base is a double-skin hollow structure;

and the base and the back and side walls are formed together as a unitary integral self-supporting free-standing, rigid structure.

3. Rack of claim 1, wherein:

the shelf support means comprises complementarily-opposed left and right grooves, which are formed respectively in the left inner skin and the right inner skin;

the grooves are so disposed in the inner skins so as to lie each with the length of the groove aligned in the direction from front to back of the respective side walls;

and the grooves are so dimensioned and arranged that the shelf can slide into and out of the grooves, in the direction from front to back of the rack.

4. Rack of claim 3, wherein the grooves are moulded into the material of the inner skin, in that the moulded inner skin is so shaped and disposed as to form two spaced parallel side walls of the groove, and a base of the groove, in the material of the inner skin.

5. Rack of claim 4, wherein the left and right outer skins are plain and smooth, in that the grooves are formed only in the inner skins.

6. Rack of claim 3, wherein, in respect of the left and right grooves, and the left and right inner skins, the groove is long and straight, and the length of the groove extends from front to back over the whole front-to-back extent of the inner skin.

7. Rack of claim 3, wherein the grooves lie with the lengths of both grooves in a common horizontal plane.

8. Rack of claim 1, wherein the distance between the inner skins of the side walls is about 45 cm, and the side walls extend forwards from the inner skin of the back wall about 15 cm.

9. Rack of claim 1, wherein the distance between the inner skins of the side walls is about 65 cm, and the side walls extend forwards from the inner skin of the back wall about 38 cm.

10. Rack of claim 3, wherein the shelf lies with left and right side edges thereof residing in the left and right grooves, and with a back edge thereof lying adjacent to or against the inner skin of the back wall.

11. Rack of claim 10, wherein:

the shelf is of depth D from front to back, and the side walls extend forwards from the back wall a distance substantially less than D;

whereby, when the shelf is assembled to the body, the shelf protrudes forwards and out from the side walls.

12. Rack of claim 11, wherein:

the side walls extend forwards from the back wall about ½ D;

whereby, when the shelf is assembled to the body, the shelf protrudes forwards and out from the side; walls about ½ D.

13. Rack of claim 3, wherein the body is provided with a plurality of pairs of such grooves, located at different heights in the side walls of the body, whereby the shelf is adjustable as to its height.

14. Rack of claim 3, wherein the rack includes detent means, which are effective to retain the shelf to the body, and to resist detachment of the shelf from the body.

15. Rack of claim 14, wherein the detent means comprises a notch in the side wall of the body, and a complementary protrusion on the shelf, the arrangement of the detent means being such that the shelf can be assembled by hand-force fully into the grooves from in front of the body, and the assembled shelf is retained in the grooves by the engagement of the protrusion in the notch.

16. Rack of claim 15, wherein the notch is cut into the floor of the groove.

17. Rack of claim 2, wherein the body was formed by rotation-moulding.

18. Rack of claim 2, wherein the shelf is a 45×30 cm rectangle; the body has an overall width of 50 cm, and an overall depth of 18 cm; and the base of the body is a 35×50 cm rectangle.

19. Rack of claim 18, wherein the body is 120 cm high.

* * * * *